US007261783B1

(12) United States Patent
MacKay et al.

(10) Patent No.: US 7,261,783 B1
(45) Date of Patent: Aug. 28, 2007

(54) LOW DENSITY, HIGH CREEP RESISTANT SINGLE CRYSTAL SUPERALLOY FOR TURBINE AIRFOILS

(75) Inventors: Rebecca A. MacKay, Strongsville, OH (US); Timothy P. Gabb, Independence, OH (US); James L Smialek, Strongsville, OH (US); Michael V. Nathal, Strongsville, OH (US)

(73) Assignee: The United States of America as Represented by the Administrator of NASA, Washington, DC (US)

( * ) Notice: Subject to any disclaimer, the term of this patent is extended or adjusted under 35 U.S.C. 154(b) by 203 days.

(21) Appl. No.: 10/946,286

(22) Filed: Sep. 22, 2004

(51) Int. Cl.
*C22C 10/05* (2006.01)

(52) U.S. Cl. ..... 148/428; 420/443; 420/445; 420/448

(58) Field of Classification Search ..... None
See application file for complete search history.

(56) References Cited

U.S. PATENT DOCUMENTS

| | | | | | |
|---|---|---|---|---|---|
| RE29,920 | E | * | 2/1979 | Baldwin | |
| 4,284,430 | A | * | 8/1981 | Henry | 148/404 |
| 4,388,124 | A | * | 6/1983 | Henry | 148/404 |
| 4,683,119 | A | * | 7/1987 | Selman et al. | 420/444 |
| 5,077,141 | A | * | 12/1991 | Naik et al. | 428/680 |
| 5,395,584 | A | * | 3/1995 | Berger et al. | 420/443 |
| 5,916,382 | A | * | 6/1999 | Sato et al. | 148/404 |
| 6,096,141 | A | * | 8/2000 | King et al. | 148/429 |
| 6,177,046 | B1 | * | 1/2001 | Simkovich et al. | 420/444 |

* cited by examiner

*Primary Examiner*—John P. Sheehan
(74) *Attorney, Agent, or Firm*—Arlene P. Neal; Kent N. Stone

(57) ABSTRACT

A nickel-base superalloy article for use in turbines has increased creep resistance and lower density. The superalloy article includes, as measured in % by weight, 6.0-12.0% Mo, 5.5-6.5% Al, 3.0-7.0% Ta, 0-15% Co, 2.0-6.0% Cr, 1.0-4.0% Re, 0-1.5% W, 0-1.5% Ru, 0-2.0%-Ti, 0-3.0% Nb, 0-0.2% Hf, 0-0.02% Y, 0.001-0.005% B, 0.01-0.04% C, and a remainder including nickel plus impurities.

10 Claims, 4 Drawing Sheets

LOW DENSITY, HIGH CREEP RESISTANT SINGLE CRYSTAL SUPERALLOY FOR TURBINE AIRFOILS

ORIGIN OF THE INVENTION

The invention described herein was made by employees of the United States Government and may be manufactured and used by or for the Government for Government purposes without payment of any royalties thereon or therefore.

BACKGROUND OF THE INVENTION

1. Field of the Invention

The present invention relates to production and use of materials that can be used with turbine airfoils. In particular, the present invention is directed to low density nickel-base superalloys with improved specific creep resistance and strength properties.

2. Description of Related Art

Nickel-base superalloys are used in the construction of some of the components of gas turbine engines that are exposed to severe temperatures and environmental conditions in the engines. For example, the turbine blades and vanes, seals, and shrouds are typically formed of such nickel-base superalloys. During service, these components are exposed to temperatures of 2000° F. or more. To perform at this high temperature for many engine cycles, the materials used in the components must have good rupture strength, a sufficiently high melting point, good thermal shock resistance, and good oxidation resistance at such high temperatures.

Turbine blades have been made from nickel-base superalloy single crystals for over twenty years. The first generation of single crystal superalloys contained no rhenium (Re). Second generation alloys typically contained 3 w/o Re and have attained successful application in commercial and military aircraft engines. Examples of these alloys include Rene N5, CMSX-4, and PWA 1484.

Third generation alloys were designed to increase the temperature capability and creep resistance further by raising the refractory metal content and lowering the chromium (Cr) level. These alloys had Re levels of ~5.5 weight percent (w/o) and Cr levels in the 2-4 w/o range. Examples of these alloys include Rene N6 and CMSX-10. A fourth generation alloy (EPM 102) was developed in the 1990's with NASA sponsorship; it is a very strong alloy due to the increased levels of rhenium and other refractory metals. EPM 102 is considered to be the state-of-the-art.

Second generation alloys are not exceptionally strong, although they have stable microstructures and good oxidation resistance. Oxidation resistance has been achieved in second generation alloys with either yttrium additions or low sulfur (<1 ppmw or 0.0001 w/o) contents. Low sulfur contents can be commercially produced in castings by using melt desulfurization or by using effective hydrogen annealing after the casting has been directionally solidified.

Third and fourth generation alloys have considerably stronger creep resistance due to the use of high levels of refractory metals in the alloy. In particular, high levels of tungsten, rhenium, and sometimes ruthenium are used for strengthening in these alloys, and these refractory metals have densities much higher than that of the nickel base.

The impact of these refractory additions is that the overall alloy density is significantly increased, such that the fourth generation alloy is about 6% heavier than second generation alloys. This weight increase may seem small, but any weight increase to the blade also cascades to the disk, shaft, etc., and increases the overall vehicle system weight by a factor of 8 to 10×. High alloy densities limit the use of the superalloy, and third and fourth generation alloys are used only in specialized applications.

The use of third and fourth generation alloys is also limited by microstructural instabilities which can debit long-term mechanical properties. The alloys are sometimes more difficult to manufacture due to additional processing steps that are needed to mitigate these microstructural instabilities. Additional processing steps add cost to the manufacturing of these alloys, and unfortunately these steps are not always successful in eliminating these instabilities. Thus, there is a need in the prior art for a unique alloying approach in order to achieve microstructural stability, high creep resistance and strength in a turbine blade alloy with low density.

SUMMARY OF THE INVENTION

According to one embodiment of the invention, a nickel-base superalloy article is disclosed. The superalloy article includes, as measured in % by weight, 6.0-12.0% Mo, 5.5-6.5% Al, 3.0-7.0% Ta, 0-15% Co, 2.0-6.0% Cr, 1.0-4.0% Re, 0-2.0% W, 0-2.0% Ru, 0-2.0% Ti, 0-3.0% Nb, 0-0.2% Hf, 0-0.02% Y, 0.001-0.005% B, 0.01-0.04% C, and a remainder including nickel plus impurities.

Additionally, the nickel-base superalloy article can include 7.0-9.5% Mo, 5.75-6.25% Al, 6.0-6.25% Ta, 0-10% Co, 2.25-5.0% Cr, 1.5-3.25% Re, 0.00% W, 0.00% Ru, 0.00% Ti, 0.00% Nb, 0-0.1% Hf, 0.0015-0.005% Y, 0.001-0.004% B, 0.01-0.02% C, and a remainder including nickel plus impurities. Also, the nickel-base superalloy article may include 7.10% Mo, 6.00% Al, 6.25% Ta, 9.85% Co, 4.70% Cr, 2.95% Re, 0.00% W, 0.00% Ru, 0.00% Ti, 0.00% Nb, 0.00% Hf, 0.0050% Y, 0.004% B, 0.010% C, and a remainder including nickel plus impurities. Alternatively, the nickel-base superalloy article may include 9.45% Mo, 6.00% Al, 6.15% Ta, 4.90% Co, 2.40% Cr, 1.45% Re, 0.00% W, 0.00% Ru, 0.00% Ti, 0.00% Nb, 0.00% Hf, 0.0045% Y, 0.003% B, 0.015% C, and a remainder including nickel plus impurities. Alternatively, the nickel-base superalloy article may include 9.00% Mo, 6.00% Al, 6.05% Ta, 0.00% Co, 2.35% Cr, 2.95% Re, 0.00% W, 0.00% Ru, 0.00% Ti, 0.00% Nb, 0.00% Hf, 0.0095% Y, 0.004% B, 0.015% C, and a remainder including nickel plus impurities.

Additionally, the superalloy article can include the alloy described above, but without yttrium and with extra low sulfur (i.e., less than 0.0001% sulfur). The composition range would be, as measured in % by weight, 6.0-12.0% Mo, 5.5-6.5% Al, 3.0-7.0% Ta, 0-15% Co, 2.0-6.0% Cr, 1.0-4.0% Re, 0-2.0% W, 0-2.0% Ru, 0-2.0% Ti, 0-3.0% Nb, 0-0.2% Hf, <0.0001% S, 0.001-0.005% B, 0.01-0.04% C, and a remainder including nickel plus impurities. Within those ranges, the article may include 7.0-9.5% Mo, 5.75-6.25% Al, 6.0-6.25% Ta, 0-10% Co, 2.25-5.0% Cr, 1.5-3.25% Re, 0.00% W, 0.00% Ru, 0.00% Ti, 0.00% Nb, 0-0.1% Hf, <0.0001% S, 0.001-0.004% B, 0.01-0.02% C, and a remainder including nickel plus impurities. Also, the nickel-base superalloy article may include 7.10% Mo, 6.00% Al, 6.25% Ta, 9.85% Co, 4.70% Cr, 2.95% Re, 0.00% W, 0.00% Ru, 0.00% Ti, 0.00% Nb, 0.00% Hf, <0.0001% S, 0.004% B, 0.010% C, and a remainder including nickel plus impurities. Alternatively, the nickel-base superalloy article may include 9.45% Mo, 6.00% Al, 6.15% Ta, 4.90% Co, 2.40% Cr, 1.45% Re, 0.00% W, 0.00% Ru, 0.00% Ti, 0.00% Nb, 0.00% Hf, <0.0001% S, 0.003% B, 0.015% C, and a remainder including nickel plus impurities. Alternatively, the nickel-base superalloy article may include 9.00% Mo, 6.00% Al, 6.05% Ta, 0.00% Co, 2.35% Cr, 2.95% Re, 0.00% W, 0.00% Ru, 0.00% Ti, 0.00% Nb, 0.00% Hf, <0.0001% S, 0.004% B, 0.015% C, and a remainder including nickel plus impurities.

Alternatively, the article may be a single-crystal component of a gas turbine, or may be a blade of the gas turbine. The article may have a density of less than about 0.311 pounds per cubic inch. Also, the sum of tungsten, ruthenium, titanium and niobium may be less than 0.1 percent or may be essentially zero.

According to another embodiment, a composition of matter is disclosed. The composition consists essentially of, in weight percent, from about 6 to about 12 percent molybdenum, from about 5.5 to about 6.5 percent aluminum, from about 3 to 7 percent tantalum, from 0 to about 15 percent cobalt, from about 2 to about 6 percent chromium, from about 1 to about 4 percent rhenium, from 0 to about 2.0 percent tungsten, from 0 to about 2.0% ruthenium, from 0 to about 2 percent titanium, from 0 to about 3 percent niobium, from 0 to about 0.2 percent hafnium, from 0 to about 0.02 percent yttrium, from about 0.001 to about 0.005 percent boron, from about 0.01 to about 0.04 percent carbon, balance nickel and minor elements.

According to another embodiment, a composition of matter is disclosed that includes the above compositional ranges but without yttrium and with extra low sulfur. The composition consists essentially of, in weight percent, from about 6 to about 12 percent molybdenum, from about 5.5 to about 6.5 percent aluminum, from about 3 to 7 percent tantalum, from 0 to about 15 percent cobalt, from about 2 to about 6 percent chromium, from about 1 to about 4 percent rhenium, from 0 to about 2.0 percent tungsten, from 0 to about 2.0% ruthenium, from 0 to about 2 percent titanium, from 0 to about 3 percent niobium, from 0 to about 0.2 percent hafnium, less than 0.0001 percent sulfur, from about 0.001 to about 0.005 percent boron, from about 0.01 to about 0.04 percent carbon, balance nickel and minor elements.

These and other variations of the present invention will be described in or be apparent from the following description of the preferred embodiments.

BRIEF DESCRIPTION OF THE DRAWINGS

For the present invention to be easily understood and readily practiced, the present invention will now be described, for purposes of illustration and not limitation, in conjunction with the following figures.

DETAILED DESCRIPTION OF PREFERRED EMBODIMENTS

Figure 1:
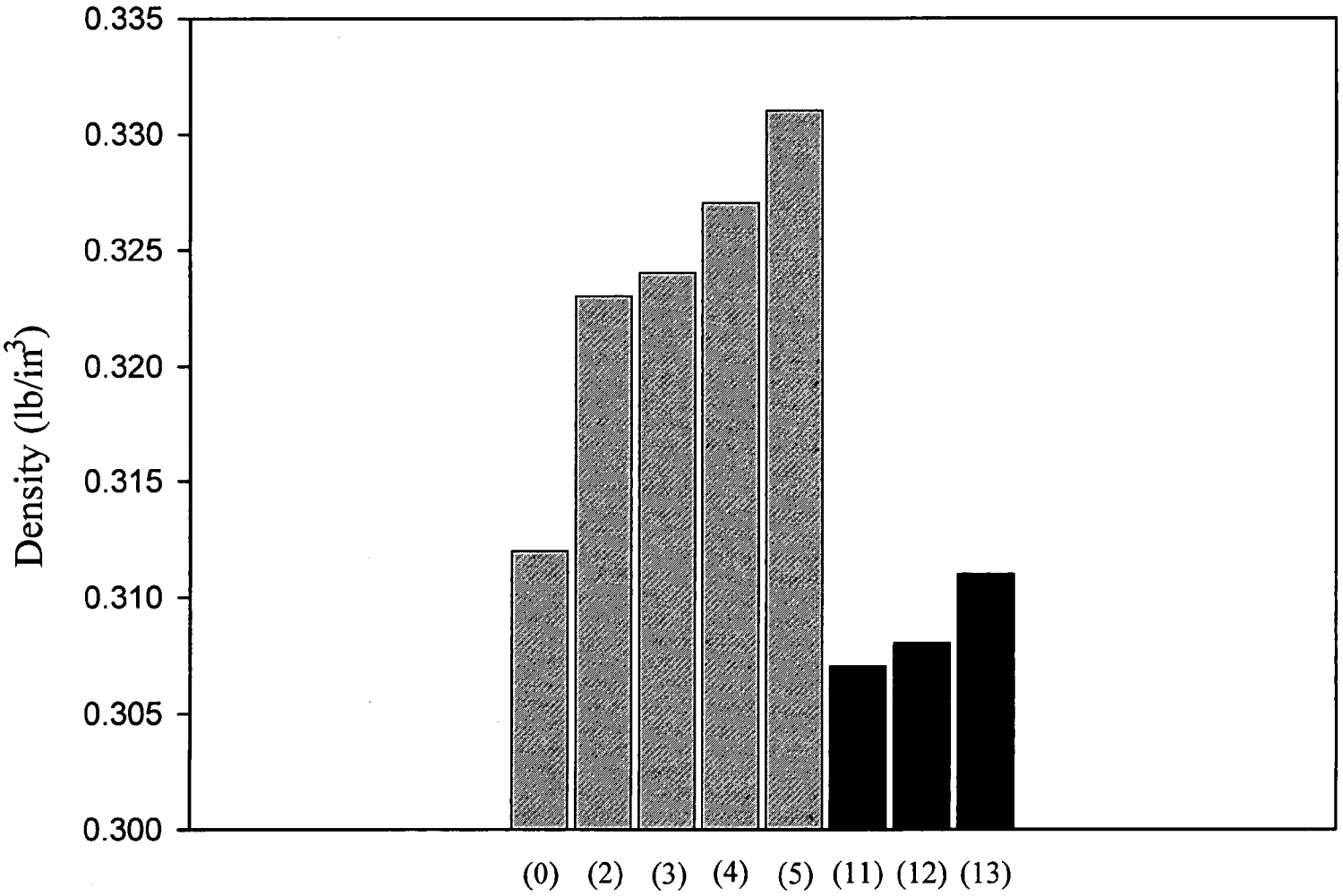
FIG. 1 provides a comparison of the densities of superalloy materials according to the prior art and the densities of superalloy materials according to several embodiments of the present invention.

A new low density nickel-base superalloy with improved specific creep resistance and strength properties has been developed for use in, for example, turbine blades of aircraft engines. The levels of alloying elements and the combination of alloying elements used in embodiments of the present invention are unique and allow for the attainment of these improved properties. The alloys developed have significantly lower densities than state-of-the-art alloys and have elevated temperature creep resistance that meet or exceed those of alloys currently in production, as well as state-of-the-art alloys.

The present invention, according to various embodiments, is directed to a single crystal superalloy composition that incorporates lower density refractory metals which provide creep strengthening without the high density. Specifically, molybdenum is the refractory metal employed to provide the bulk of the strengthening, and this element has a density that is close to that of the nickel base. High density alloy elements, such as tungsten and ruthenium, were largely not incorporated in the alloy composition, and low levels of rhenium were used. Cobalt was added to the alloy because it stabilizes the microstructure of the alloy, in a manner similar to ruthenium. Yttrium was added for improved oxide scale adhesion; alternatively, reducing the sulfur impurity level to less than 0.0001% by techniques known to those in the art can have the same effect as an yttrium addition.

Chromium was added to the alloys of the present invention to improve the oxidation resistance. However, adding too much chromium can also cause instabilities thereby reducing the alloy strength. Thus, the chromium levels were kept at modest levels in an effort to achieve a sufficient balance of properties between oxidation resistance, stability, and strength. One feature of this invention is that it provides a novel, highly advantageous combination of the low density of some second generation blade alloys with the high creep strength of the fourth generation superalloy.

TABLE 1 lists some examples of compositions and densities of the alloys according to the present invention. For comparison purposes, the chemistries and densities of the second, third, and fourth generation alloys are also listed in the table. Comparison of the individual alloying elements and their corresponding levels reveals that the alloys in this invention are unique. The high level of molybdenum, the absence of tungsten and ruthenium, the useful range of cobalt, and the lower tantalum contents in particular distinguish the present invention from the prior art materials. The use of these alloying elements in the present invention results in markedly lower alloy densities than second, third, and fourth generation alloys.

TABLE 1

| | (11) LDS-1101 | (12) LDS-5555 | (13) LDS-5051 | (0) Rene N5 | (1) CMSX-4 | (2) PWA 1484 | (3) Rene N6 | (4) CMSX-10 Ri | (5) EPM 102 |
|---|---|---|---|---|---|---|---|---|---|
| Ni | bal | bal | bal | bal | bal | bal | bal | bal | bal |
| Mo | 7.10 | 9.45 | 9.00 | 2.00 | 0.60 | 2.00 | 1.40 | 0.60 | 2.00 |
| Al | 6.00 | 6.00 | 6.00 | 6.20 | 5.60 | 5.60 | 5.75 | 5.80 | 5.55 |
| Ta | 6.25 | 6.15 | 6.05 | 7.00 | 6.50 | 8.70 | 7.20 | 7.50 | 8.25 |
| Co | 9.85 | 4.90 | 0.00 | 8.00 | 9.00 | 10.00 | 12.50 | 7.00 | 16.50 |
| Cr | 4.70 | 2.40 | 2.35 | 7.00 | 6.50 | 5.00 | 4.20 | 2.65 | 2.00 |
| Re | 2.95 | 1.45 | 2.95 | 3.00 | 3.00 | 3.00 | 5.40 | 5.50 | 5.95 |
| W | 0.0 | 0.0 | 0.0 | 5.00 | 6.00 | 6.00 | 6.00 | 6.40 | 6.00 |
| Ru | 0.0 | 0.0 | 0.0 | 0.0 | 0.0 | 0.0 | 0.0 | 0.00 | 3.00 |
| Ti | 0.0 | 0.0 | 0.0 | 0.0 | 1.00 | 0.0 | 0.0 | 0.80 | 0.00 |
| Nb | 0.0 | 0.0 | 0.0 | 0.0 | 0.0 | 0.0 | 0.0 | 0.40 | 0.00 |
| Hf | 0.0 | 0.0 | 0.0 | 0.20 | 0.10 | 0.10 | 0.15 | 0.06 | 0.15 |
| Y | 0.005 | 0.004 | 0.010 | | | | 0.010 | | 0.01 |
| B | 0.004 | 0.003 | 0.004 | | | | 0.004 | | 0.004 |
| C | 0.010 | 0.015 | 0.015 | | | | 0.050 | | 0.03 |
| Density ($lb/in^3$) | 0.311 | 0.308 | 0.307 | 0.312 | 0.314 | 0.323 | 0.324 | 0.327 | 0.331 |

In TABLE 1, (11) is LDS-1101, (12) is LDS-5555 and (13) is LDS-5051. These represent different examples of the present invention. The comparison materials are: (0) as Rene N5, (1) as CMSX-4, (2) as PWA 1484, (3) as Rene N6, (4) as CMSX-10 Ri and (5) as EPM102. The above discussed properties of present invention in comparison with the prior art are also presented graphically in FIG. 1. The exemplary alloys of the present invention, (11), (12) and (13), have densities lower than second, third, and fourth generation alloys (0) and (2)-(5). The numbers used in FIG. 1 for the alloys are the same as those discussed above for TABLE 1.

Figure 2:
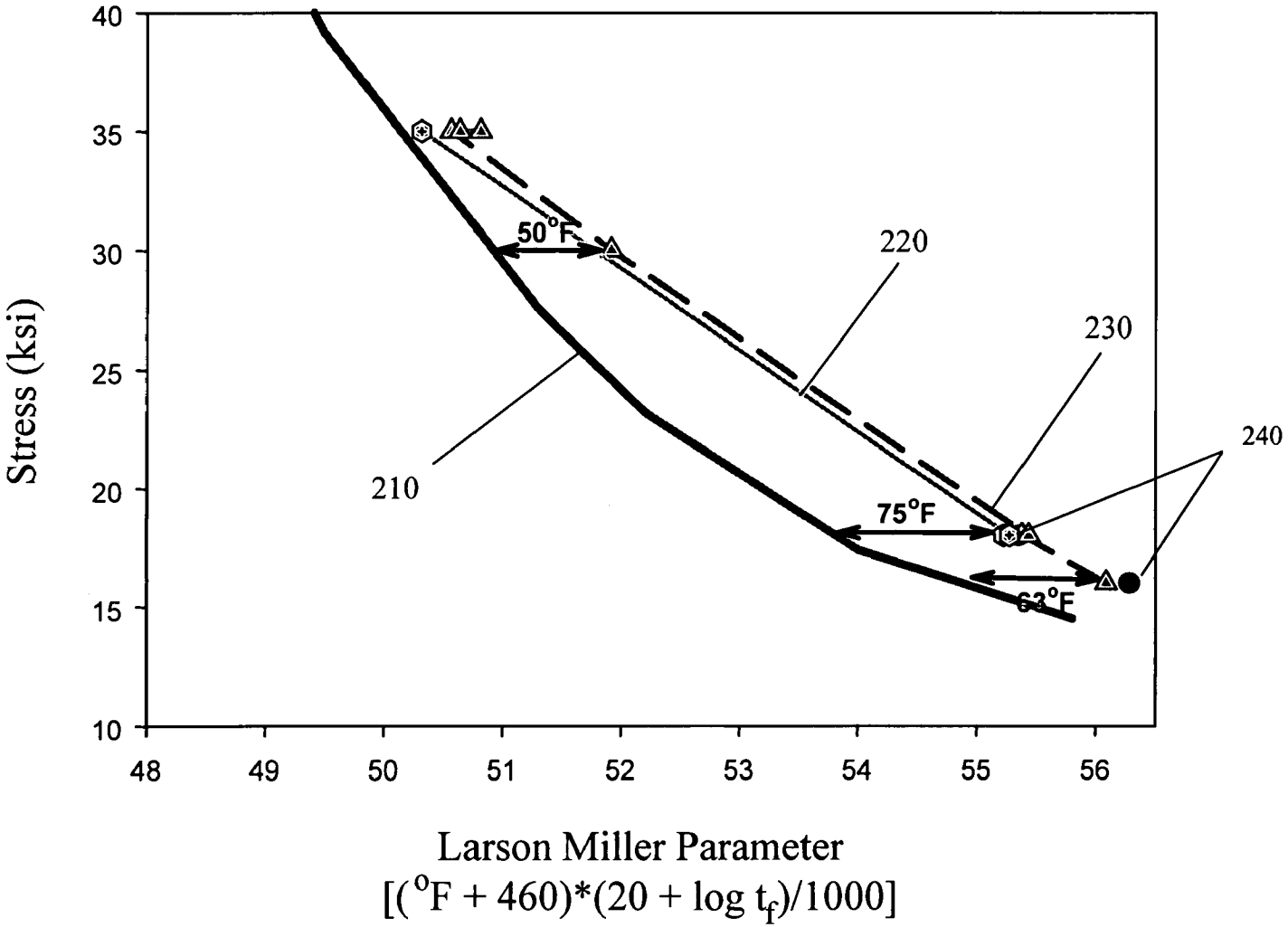
FIG. 2 provides graph illustrating the temperature advantages of superalloy materials according to several embodiments of the present invention when compared with the prior art material Rene N5.

The creep resistances of different alloys are often compared using a Larson Miller Parameter plot, which enables alloys to be compared over a range of applied stresses and creep testing temperatures. A series of Larson Miller Parameter plots in FIGS. 2 through 4 demonstrate several advantages of the alloys of the present invention. It is noted that while CMSX-4 was discussed above, it is not represented in FIGS. 2-4, although other prior generation alloys are represented for comparison. A first advantage demonstrated is that the creep rupture strength of the present invention materials exceeds that of second generation production alloy Rene N5. This second generation production alloy is disclosed in W. S. Walston et al., "René N6: Third Generation Single Crystal Superalloys," in *Superalloys* 1996, R. D. Kissinger et al., eds., Minerals, Metals & Materials Society, (1996), pp. 27-34. FIG. 2 illustrates that a very significant 50 to 75° F. temperature advantage is provided by the present invention over a wide range of stresses. The curve indicated by 210 is that for Rene N5 and curves 220 and 230 correspond to LDS-5051 and LDS-1101, as discussed above. Data at 16 and 18 ksi indicated by the closed circle are labeled 240 and correspond to LDS-5555. The alloys of the present invention also have slightly lower densities than Rene N5, and thus the temperature advantage of those alloys would be increased slightly if the stress was corrected for density.

Figure 3:
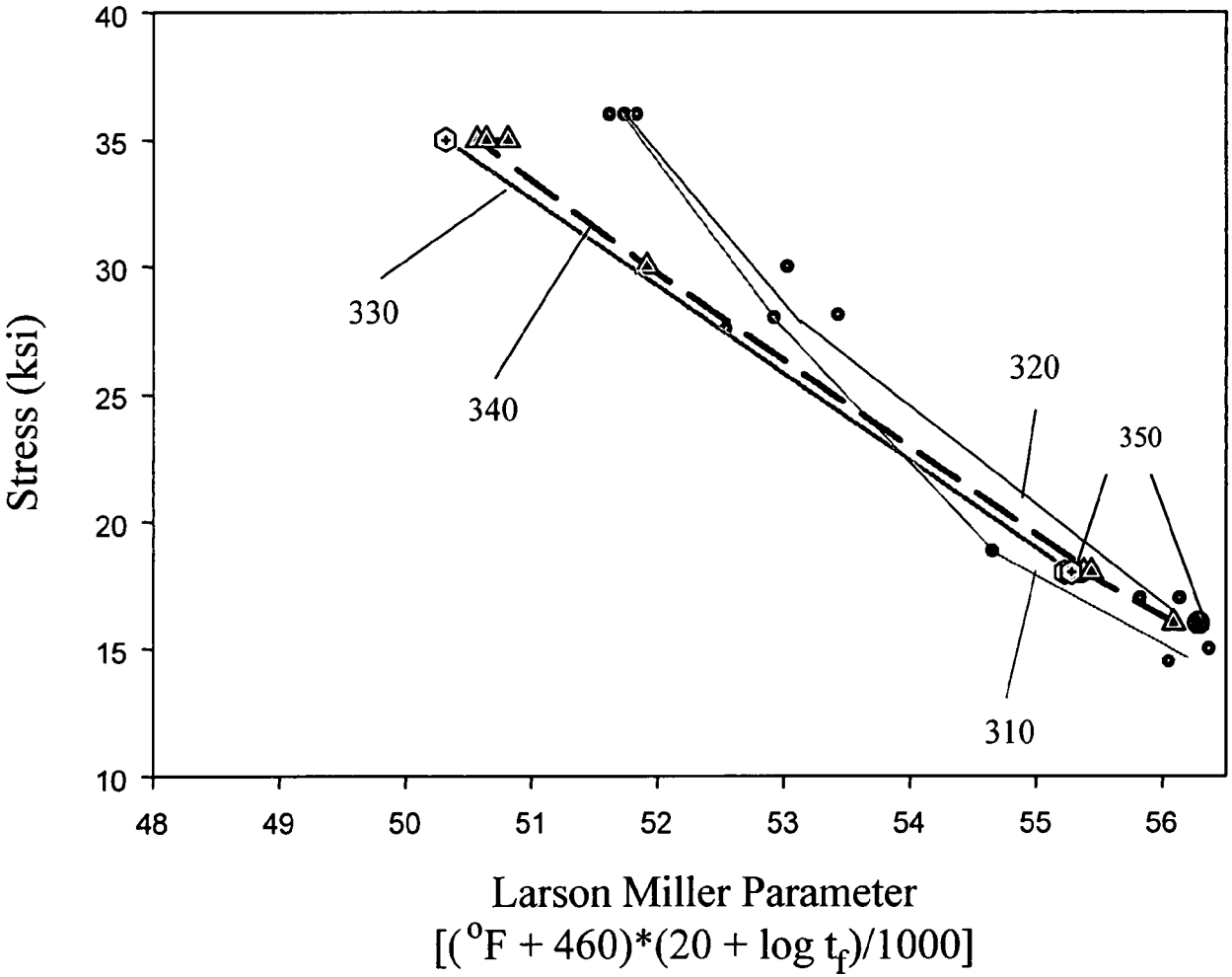
FIG. 3 provides a graph illustrating the comparable strengths of superalloy materials according to several embodiments of the present invention when compared with the prior art third and fourth generation alloys in a high temperature and low stress regime.

FIG. 3 provides the creep test data for the alloys of the present invention, third generation CMSX-10, and fourth generation EPM 102. The curve indicated by 310 is that for CMSX-10, the curve indicated by 320 is that for EPM 102 and curves 330 and 340 correspond to LDS-5051 and LDS-1101, respectively, as discussed above. Data at 16 and 18 ksi indicated by the closed circle are labeled 350 and correspond to LDS-5555. CMSX-10 is discussed in G. L. Erickson, "The Development and Application of CMSX®-10," in *Superalloys* 1996, R. D. Kissinger et al., eds., Minerals, Metals & Materials Society, (1996), pp. 35-44. EPM 102 is discussed in *Enabling Propulsion Materials Program: Final Technical Report*, Volume 4, Task J—Long-Life Turbine Airfoil Materials System, 1 Oct. 1998 to 31 Oct. 1999, NASA Contract NAS 3-26385, May 2000. Duplicate test results were obtained from the above references and are included in the figure.

FIG. 3 shows that the third and fourth generation alloys have significantly greater creep resistances than the present invention at high stress levels. However, for the lower stress regime, the creep data for the third and fourth generation alloys converge with those of the present invention. In the 14 to 22 ksi stress range, EPM 102 has only slightly improved creep strengths than the alloys of the present invention, and in turn, the alloys of the present invention have slightly improved creep strengths over CMSX-10. However, the alloys of the present invention provide these creep strengths at significantly reduced densities relative to EPM 102 and CMSX-10, and FIG. 3 does not take into account these substantial density differences. The densities of the alloys of the present invention are 6 to 7% lower than EPM 102 and 5 to 6% lower than CMSX-10.

Figure 4:
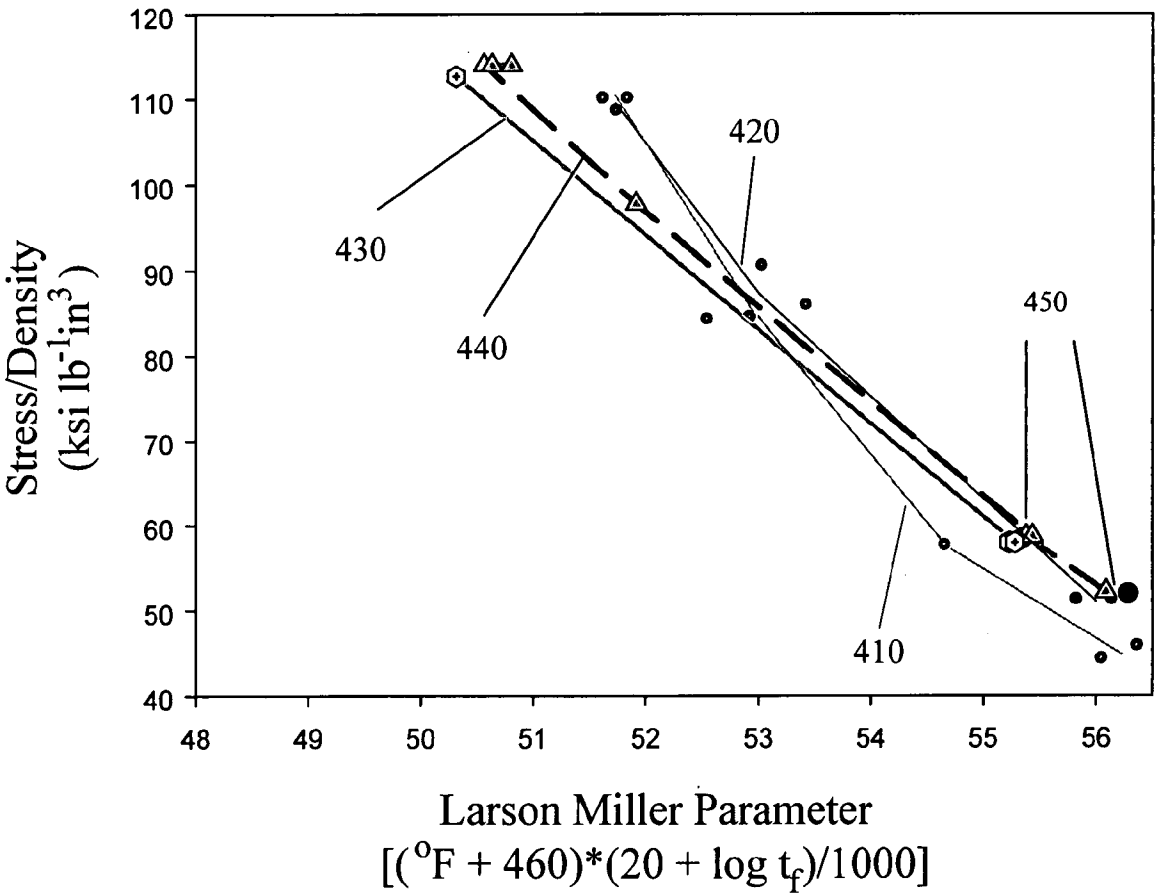
FIG. 4 provides a graph illustrating the strength advantages of superalloy materials according to several embodiments of the present invention when compared with the prior art materials when alloy density is taken into account.

When the creep strengths are normalized for alloy density, the alloys of the present invention have creep strengths very similar to fourth generation EPM 102 over a wide range of stresses. This is illustrated in FIG. 4. The curve indicated by 410 is that for CMSX-10, the curve indicated by 420 is that for EPM 102 and curves 430 and 440 correspond to LDS-5051 and LDS-1101, respectively, as discussed above. Data in the low applied stress regime indicated by the closed circle are labeled 450 and correspond to LDS-5555. Furthermore, it may be seen that the alloys of the present invention provide up to a 40° F. temperature advantage over third generation CMSX-10. Thus, alloy density plays a significant role and the strength capability of the low density alloys of the present invention provides potential benefits for turbine blade applications. The low applied stress regime represents high temperature turbine blade applications, and it is under these conditions that the present invention can be used to great benefit.

Thus, a new low density nickel-base superalloy with improved specific creep resistance and strength properties has been developed for use in turbine blades of aircraft engines. The levels of alloying elements and the combination of alloying elements used in the embodiments of the present invention are unique and result in improved properties. The alloys developed have significantly lower densities than state-of-the-art alloys and have elevated temperature creep resistance that meet or exceed those of alloys currently in production, as well as state-of-the-art alloys. Alloy density has a significant impact because overall vehicle system weight can be reduced, and a reduction in the density of rotating parts results in a 8 to 10× multiplier in total engine weight savings, which translates into reduced fuel consumption and reduced emissions.

Although the invention has been described based upon these preferred embodiments, it would be apparent to those skilled in the art that certain modifications, variations, and alternative constructions would be apparent, while remaining within the spirit and scope of the invention. In order to determine the metes and bounds of the invention, reference should be made to the appended claims.

The invention claimed is:

1. A nickel-base superalloy article, comprising (measured in % by weight):

6.0-12.0% Mo;
5.5-6.5% Al;
3.0-7.0% Ta;
0-15% Co;
2.0-6.0% Cr;
1.0-4.0% Re;
0-2.0% W;
0-2.0% Ru;
0-2.0% Ti;
0-3.0% Nb;
0-0.2% Hf;
0-0.02% Y;
0.001-0.005% B;
0.01-0.04% C;
and a remainder including nickel plus impurities wherein the article is a single crystal component of a gas turbine.

2. A nickel-base superalloy article as claimed in claim 1, comprising (measured in % by weight):

7.0-9.5% Mo;
5.75-6.25% Al;
6.0-6.25% Ta;
0-10% Co;
2.25-5.0% Cr;
1.5-3.25% Re;
0.00% W;
0.00% Ru;
0.00% Ti;
0.00% Nb;
0-0.1% Hf;
0.0015-0.005% Y;
0.001-0.004% B;
0.01-0.02% C;
and a remainder including nickel plus impurities.

3. The nickel-base superalloy article as claimed in claim 2, comprising (measured in % by weight):

7.10% Mo;
6.00% Al;
6.25% Ta;
9.85% Co;
4.70% Cr;
2.95% Re;
0.00% W;
0.00% Ru;
0.00% Ti;
0.00% Nb;
0.00% Hf;
0.0050% Y;
0.004% B;
0.010% C;
and a remainder including nickel plus impurities.

4. The nickel-base superalloy article as claimed in claim 2, comprising (measured in % by weight):

9.45% Mo;
6.00% Al;
6.15% Ta;
4.90% Co;
2.40% Cr;
1.45% Re;
0.00% W;
0.00% Ru;
0.00% Ti;
0.00% Nb;
0.00% Hf;
0.0045% Y;
0.003% B;
0.015% C;
and a remainder including nickel plus impurities.

5. The nickel-base superalloy article as claimed in claim 2, comprising (measured in % by weight):

9.00% Mo;
6.00% Al;
6.05% Ta;
0.00% Co;
2.35% Cr;
2.95% Re;
0.00% W;
0.00% Ru;
0.00% Ti;
0.00% Nb;
0.00% Hf;
0.010% Y;
0.004% B;
0.015% C;
and a remainder including nickel plus impurities.

6. The nickel-base superalloy article as claimed in one of claims 1-5, wherein the yttrium is 0.0015% by weight and sulfur content is less than 0.0001% by weight.

7. The nickel-base superalloy article as claimed in claim 1, wherein the single-crystal component comprises a blade of the gas turbine.

8. The nickel-base superalloy article as claimed in claim 1, wherein the article has a density of less than about 0.311 pounds per cubic inch.

9. The nickel-base superalloy article as claimed in claim 1, wherein the sum of tungsten, ruthenium, titanium and niobium is less than 0.1 percent.

10. The nickel-base superalloy article as claimed in claim 9, wherein the sum of tungsten, ruthenium, titanium and niobium is essentially zero.

* * * * *